US005450641A

United States Patent [19]

Montgomery

[11] Patent Number: 5,450,641

[45] Date of Patent: Sep. 19, 1995

[54] INFLATABLE BED RAIL GUARD

[75] Inventor: Mark W. Montgomery, Wolcott, Conn.

[73] Assignee: Connecticut Artcraft Corp, Naugatuck, Conn.

[21] Appl. No.: 262,833

[22] Filed: Jun. 21, 1994

[51] Int. Cl.[6] ..... A47C 21/00; A47C 21/08

[52] U.S. Cl. ..... 5/663; 5/425; 5/922

[58] Field of Search ..... 5/663, 425, 424, 449, 5/455, 922

[56] References Cited

U.S. PATENT DOCUMENTS 3,742,530 7/1973 Clark ..... 5/663

4,523,745 6/1985 Killman et al. ..... 5/424

5,075,910 12/1991 Morten ..... 5/53.1

*Primary Examiner*—Alexander Grosz

[57] ABSTRACT

A guard for a bed rail includesa first generally rectangular flat inflatable member having opposite elongated sides and opposite ends perpendicular to the first member sides and first and second generally rectangular non-inflatable flat elongated like strips. Each strip is much narrower than the first member. Each strip extends along a corresponding side of the first member and is secured thereto. A second generally rectangular flat inflatable member having opposite elongated sides and opposite ends perpendicular to the second member sides, extends in the same direction as the first member. One side of the second member is disposed adjacent, parallel and secured to one of the first and second strips.

2 Claims, 1 Drawing Sheet

FIG. 1
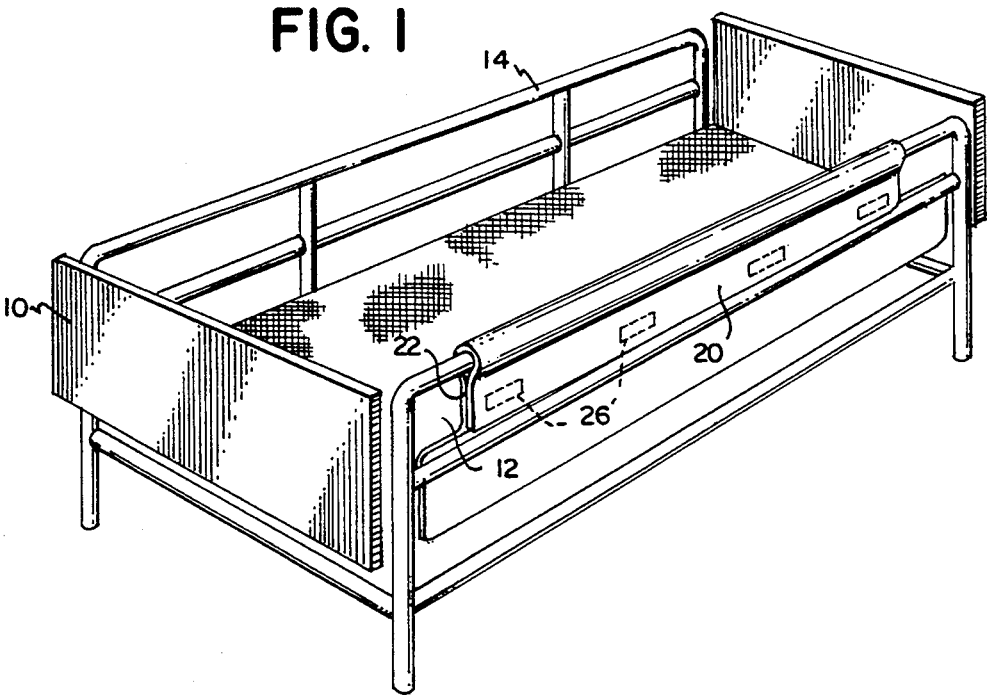
FIG. 2
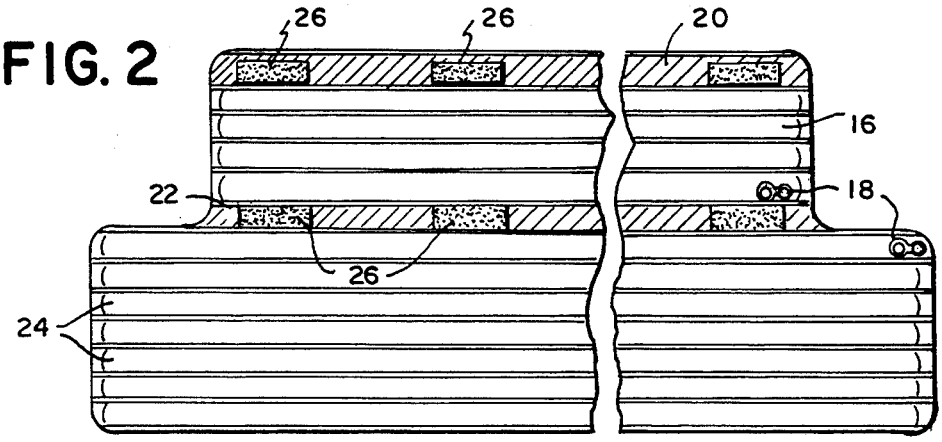
FIG. 3
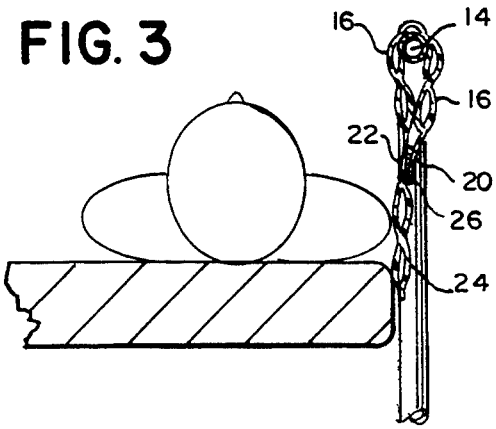
FIG. 4
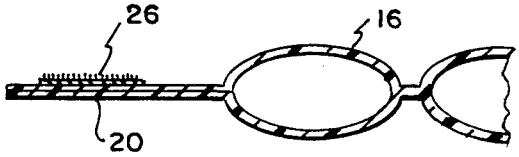
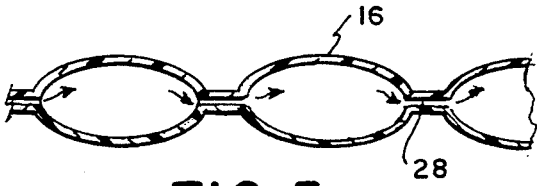
FIG. 5

INFLATABLE BED RAIL GUARD

BACKGROUND OF THE INVENTION

Hospital beds have at least one or two opposite detachable horizontally elongated bed rails secured to opposite sides of the bed to prevent the patient from rolling off the bed. Each rail are normally made of metal and has a top horizontal bar spaced above the ramainder of the rail. The patient may accidentally move into contact with the rail and bruise or aggravate bed sores or the like. To minimize pain or injury caused by such contact, it is known to cover the rail with detachable padded rail guards. These guards are relatively expensive. They are bulky and cannot be stored easily. Their external surfaces are not easily cleaned when soiled.

The present invention is directed toward a new type of rail guard which overcomes these disadvantages.

SUMMARY OF THE INVENTION

Accordingly, it is an object of this invention to provide a new and improved type of rail guard which can be inflated when in use and deflated when not in use whereby it is not bulky when deflated and can be stored easily.

Another object is to provide a new and improved rail guard of the character indicated which is relatively inexpensive and has external surfaces which can be easily cleaned.

These and other objects and advantages of this invention will either be explained or will become apparent hereinafter.

In accordance with the principles of this invention, a guard for a bed rail employs a first generally rectangular flat inflatable member having opposite elongated sides and opposite ends perpendicular to the first member sides.

The guard also employs first and second generally rectangular non-inflatable flat elongated like strips. Each strip is much narrower than said first member. Each strip extends along a corresponding side of the first member and is secured thereto.

The guard also employs a second generally rectangular flat inflatable member having opposite elongated sides and opposite ends perpendicular to the second member sides. The second member extends in the same direction as the first member. One side of the second member is disposed adjacent, parallel and secured to one of said first and second strips.

The first member is narrower and shorter than the second member, each end of the first member being disposed inwardly with respect to the corresponding end of the second member.

Each of the first and second strips is provided with spaced apart securing means, the means on the first strip being detachably securable to the means on the second strip.

In use, the guard is adapted to be detachably secured to a horizontal bed rail which in turn is secured to the side of a bed. The rail has an inner surface adjacent the bed, an outer surface remote from the bed and a top horizontal bar. The second member covers the inner surface of the rail. The first member is wrapped around the bar and is secured thereto by said means when engaged.

BRIEF DESCRIPTION OF THE DRAWINGS

FIG. 1 is a perspective view showing the invention in use.

FIG. 2 is a plan view of a preferred embodiment of the invention.

FIG. 3 is a detailed cross sectional view of the structure shown in FIG. 1.

FIGS. 4 and 5 are detail cross sectional views of the structure shown in FIG. 2.

DETAILED DESCRIPTION OF PREFERRED EMBODIMENT

Referring now to FIGS. 1–5, there is shown a hospital bed 10 having a horizontally elongated bed rail 12 having an inner surface adjacent the bed and an outer surface remote from the bed. The rail has a top horizontal guide bar 14 disposed spaced above the remainder of the rail.

The guard for a bed rail employs a first generally rectangular flat inflatable member 16 with air valve 18. Member 16 has opposite elongated sides and opposite ends perpendicular to the first member sides.

First and second generally rectangular non-inflatable flat elongated like strips 20 and 22 are also employed. Each strip is much narrower than member 16 but is equal in length thereto. Each strip extends along a corresponding side of member 16 and is secured thereto.

A second generally rectangular flat inflatable member 24 has air valve 18. Member 24 has opposite elongated sides and opposite ends perpendicular to the second member sides. The second member extends in the same direction as the first member. One side of tile second member is disposed adjacent, parallel and secured to strip 22.

The member 16 is narrower and shorter than member 24 so that each end of member 16 is disposed inwardly with respect to the corresponding end of member 24.

Each of the first and second strips is provided with spaced apart securing means 26 which are shown as hook and loop type, the means on the first strip being detachably securable to the means on the second strip.

The rail 12 has an inner surface adjacent the bed and an outer surface remote from the bed. In use, member 24 covers the inner surface of the rail. Member 16 is wrapped around the bar and is secured thereto by the engaged hook and loop type elements.

The members and strips are constructed in the same manner as conventional air mattresses used in hospitals. Each of the members has adjacent sections which are interconnected either at communicating open ends 28 or via air carrying channels or the like.

While the invention has been described with particular reference to the drawings and preferred embodiment, the protection sought is to be limited only by the terms of the claims which follow.

What is claimed is

1. A detachable guard for a bed rail, adapted to prevent contact between a patient and a bed rail, comprising:

a first generally rectangular flat inflatable member having opposite elongated sides and opposite ends perpendicular to the first member sides;

first and second generally rectangular non-inflatable flat elongated like strips, each strip being much narrower than said first member, each strip extending along a corresponding side of the first member and secured thereto, each of the first and second strips being provided with spaced apart securing means, the means on the first strip being detachably securable to the means on the second strip; and a second generally rectangular flat inflatable member having opposite elongated sides and opposite ends perpendicular to the second member sides, the second member extending in the same direction as the first member, one side of the second member being disposed adjacent, parallel and secured to one of said first and second strips, wherein said first member is narrower and shorter than the second member, each end of the first member being disposed inwardly with respect to the corresponding end of the second member.

2. The guard of claim 1 which is adapted to be detachably secured to a horizontal bed rail which in turn is secured to the side of a bed, the rail having an inner surface adjacent the bed, an outer surface remote from the bed and a top horizontal bar, the second member covering the inner surface of the rail, the first member being wrapped around the bar and being secured thereto by said means when engaged.

* * * * *